United States Patent [19]

Ceolotto

[11] 4,336,695

[45] Jun. 29, 1982

[54] COMPRESSION REFRIGERATION UNIT ADJUSTABLE IN ACCORDANCE WITH THE LIQUID FLOWING OUT FROM THE EVAPORATOR

[75] Inventor: Egidio Ceolotto, Varedo, Italy

[73] Assignee: Monseol Limited, Chiasso, Switzerland

[21] Appl. No.: 171,550

[22] Filed: Jul. 23, 1980

[30] Foreign Application Priority Data

Apr. 18, 1980 [CH] Switzerland ..... 3037/80
Jun. 16, 1980 [CH] Switzerland ..... 4595/80

[51] Int. Cl.[3] ..... F25B 39/02

[52] U.S. Cl. ..... 62/504; 62/528; 62/219

[58] Field of Search ..... 62/219, 220, 221, 504, 62/527, 528

[56] References Cited

U.S. PATENT DOCUMENTS 2,097,815 11/1937 Harvey ..... 62/221
2,568,711 9/1951 Bosi ..... 62/219
3,262,280 7/1966 Chaney ..... 62/49

*Primary Examiner*—Ronald C. Capossela
*Attorney, Agent, or Firm*—Young & Thompson

[57] ABSTRACT

A device according to the present invention comprises one or more compression units for compressing a cooling gas fluid, one or more condensers for cooling and condensing the cooling fluid, an expansion device and one or more evaporators for the evaporation of the expanded coolant, according to which the supply, adjustment and expansion device supplying the evaporator or evaporators is a device in which the supply, adjustment and expansion of the cooling fluid is carried out by a fixed injector nozzle and by an inlet device of varying section depending on the amount of liquid outflowing from the evaporator or evaporators.

Preferably, the liquid from the evaporator or evaporators is introduced into a container in which it is collected, so that by sensing the liquid level by means of a probe the inlet device of varying section can be controlled.

6 Claims, 2 Drawing Figures

Figure 1:
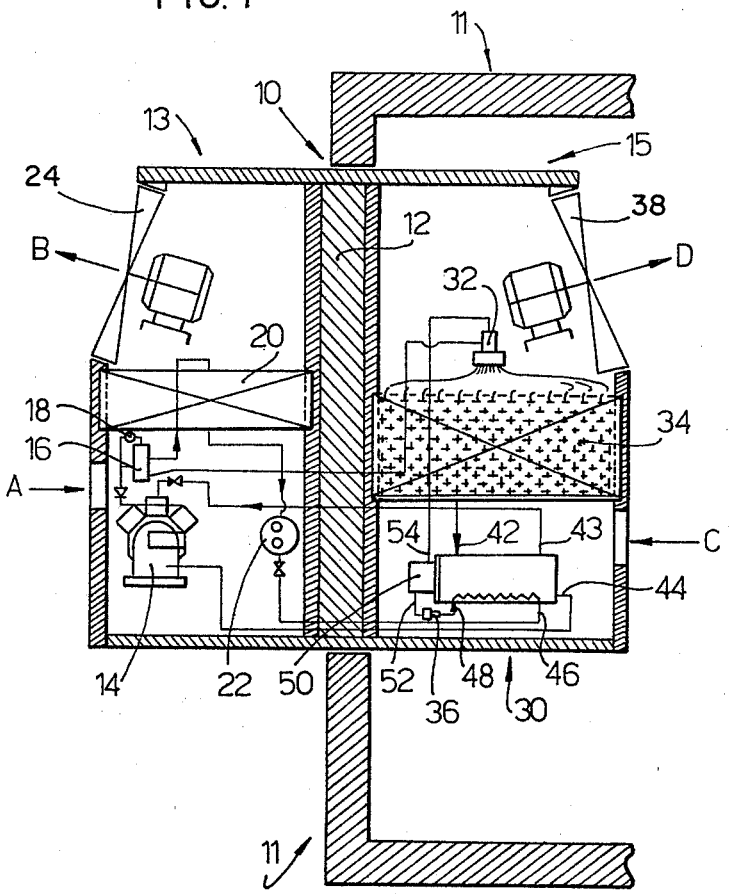

COMPRESSION REFRIGERATION UNIT ADJUSTABLE IN ACCORDANCE WITH THE LIQUID FLOWING OUT FROM THE EVAPORATOR

This application relates to compression refrigerator units or freezing machines which, for example, are generally used in refrigerating rooms or freezers for foodstuffs and the like.

The known refrigerator units of the above mentioned type generally operate with a refrigerating gas, such as Freon 12, Freon 22, Freon 502, ammonia, etc. Generally, these units essentially comprise one or more compressors, one or more condensers or heat exchangers, one or more expansion valves, and one or more static or ventilated evaporators. The cooling or refrigerating gas is compressed by the compressor, cooled and liquefied by air or water stream in the condenser, then expanded in the expansion valves and evaporated in the evaporator, in this step absorbing heat from the medium to be cooled or refrigerated. The vapour is then brought back to the compressor, but the liquid (oil, oil mixed with cooling gas) therein contained should be previously separated; the oil is reused for compressor lubrication.

As above stated, the evaporator is generally supplied by one or more thermostatic expansion valves, which may be of different types. Each of the thermostatic valves may provide for expansion within a fixed temperature range. Therefore, where a wider temperature range is demanded, further thermostatic valves have to be mounted, which is complicated.

It is a further disadvantage of the prior art refrigerator units that the thermostatic valves require continuous operations on the system for their adjustment and maintenance.

Finally, still another problem in the prior art compression systems is the difficult separation of the gas fluid from the liquid consisting of a mixture of cooling fluid and lubricating oil, before the gas fluid is passed to the compressor.

Therefore, it is the object of the present invention to provide a supply device for one or more evaporators in a refrigerator system, which can replace all of the conventional systems as presently used (such as capillaries, thermostatic valves, solenoid or electro-interlocked valves), overcoming all of the problems relating to supply, expansion and adjustment of a cooling fluid to the evaporator or evaporators, simplifying the circuit, reducing the components in the system, enabling an easy separation of oil from the cooling fluid and mainly allowing the use of any temperature required by users (cells, liquid coolers or freezers, etc.).

The above specified object has been accomplished by providing a refrigerator unit comprising one or more compression units for compressing a cooling gas fluid, one or more condensers for cooling and condensing the refrigerating fluid, an expansion device, and one or more evaporators for evaporating the expanded coolant, according to which the supply, adjustment and expansion device supplying the evaporator or evaporators is a device in which the supply, adjustment and expansion of the cooling fluid are carried out both by a fixed injector nozzle and an inlet device of varying section depending on the amount of liquid outflowing from the evaporator or evaporators.

The invention contemplates that the fixed injector nozzle is calibrated depending on the capacity of the evaporator or evaporators.

An embodiment of the invention provides that the liquid outflowing from the evaporator or evaporators is fed to a container having a means therein for sensing the liquid level, which means serves to adjust the inlet device of varying section.

In the above mentioned case, the liquid level sensor means can be a float directly operating the inlet device of varying section.

On the other hand, said liquid level sensor means can be an electric or electronic probe, while the operation of varying inlet is effected by means of an electric servo-control.

The above mentioned embodiment comprising a container could also contemplate one or more outlets for the recovery of lubricating oil.

A further improvement, still including a container, contemplates that said fixed injector nozzle and inlet device of varying section are both combined or incorporated in a single expansion block, which is made integral to the tank. In this case, it is also preferably provided an easy assembling of said container block, so as to enable an easy and ready cleaning.

Figure 2:
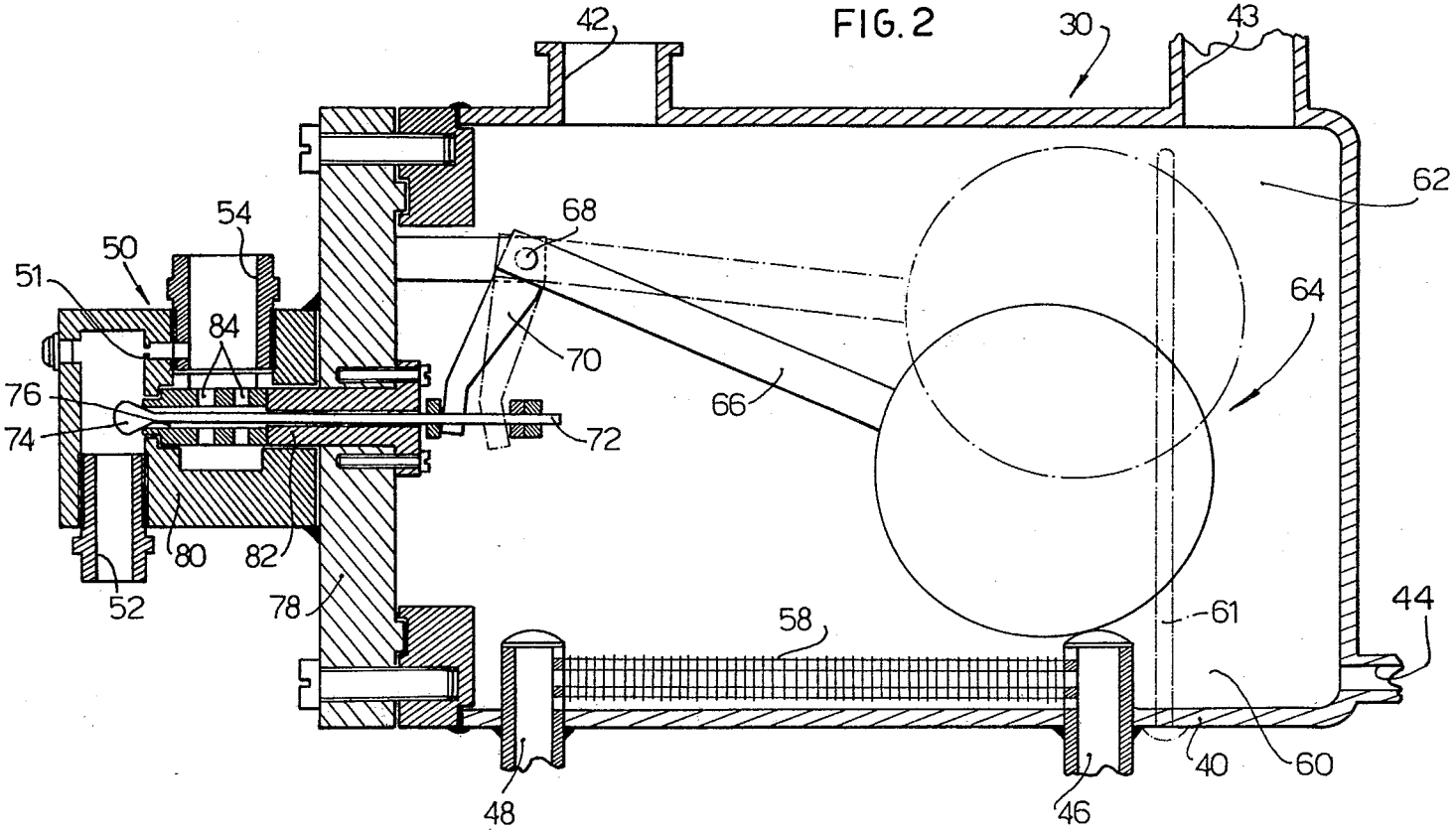

A more detailed description of the invention will now be given by explaining a specific exemplary embodiment which should be considered only as an unrestrictive indication of the invention, example which will be described with reference to the accompanying drawings, in which:

FIG. 1 is a diagrammatic view showing a refrigerator unit according to the present invention; and FIG. 2 is a sectional view showing the above mentioned operating block.

The subject refrigerator system is a compression system and operates with a cooling or refrigerating fluid such as, for example, Freon 12, Freon 22, Freon 502 and ammonia.

Referring to FIG. 1, a compression refrigerator system 10 for a refrigerating room or freezer essentially comprises a portion 13 arranged externally of the refrigerating room or freezer 11 and a portion 15 internally of said freezer. The outer portion 13 and the inner portion 15 are separated by insulating panels, schematically shown and designated at 12. The outer portion 13 of the refrigerating room or freezer 11 comprises a compressor 14, an automatic defroster 16 (having a timer-controlled solenoid valve 18 at upstream location thereof), a condenser 20, a liquid collection tank 22, and a fan 24, as well as the required connection conduits.

The inner portion 15 of said refrigerating room or freezer 11 comprises a supply, adjustment and expansion device 30 to be further described in the following, a distribution block 32, an evaporator 34, a filter 36, and a fan 38.

This device 30 is more clearly shown in FIG. 2. It comprises a container 40 provided with a top inlet 42 for the liquid and saturated gas for the evaporator 34, a top outlet 43 for the outlet of the gas and evaporated liquid which are led to the compressor 14, a bottom outlet 44 for oil recovery, which is connected to the oil sump beneath the compressor, an inlet 46 for the liquid from the liquid collection tank 22, and an outlet 48 for said liquid introduced through inlet 46. Said device 30 also has an expansion block 50, in which the expansion and adjustment of the cooling fluid is effected, which expansion block 50 has an inlet 52 for the fluid coming from 48 and a fluid outlet 54.

The expansion of the fluid from the liquid collection tank 22 through the heat exchanger 58 partly occurs through the injector nozzle 51 directly opening into said outlet 54 and partly occurs through the inlet device 76, 74 of adjustable section, the outlets 84 of which extend to the outlet 54 of the above mentioned expansion block 50.

A heat exchanger 58 of any desired type is interposed between said inlet 46 and outlet 48 for the pressure liquid. The bottom of container 40 is a basin or tank 60 for collecting the liquid arriving therein from the evaporator outlet. Such a liquid comprises lubricating oil and cooling fluid not evaporated in the evaporator.

The top portion of said container 40 forms a chamber 62 for the gas (gaseous cooling fluid).

A float 64 is accommodated in said chamber 62 and in the figures of the accompanying drawings is shown at two possible extreme positions. This float 64 is integral with a first arm 66 pivoted at 68 at a fixed location. By its free end, a second arm 70 integral with said first arm 66 controls an axially movable stem 72. At the opposite end to said second arm 70, said stem 72 carries a head 74 preferably of conical shape which on moving will uncover to a higher or lower degree an expansion port or passage 76 connecting said inlet e2 to outlet 54, thus providing an inlet device of varying section.

In a presently preferred embodiment, which can be readily disassembled for cleaning, servicing and replacing operations, a plate 78 is a wall of said container 40 and on one hand supports the fulcrum 68 and on the other hand the body 80 of said expansion block. A tubular element 82, having the passage 76 formed therein, is secured to said plate 78 and accommodated within said body 80, this tubular element having holes 84 for the connection of said passage 76 with said outlet 54. Of course, all the required seals or gaskets are provided for avoiding any communication between the inside of block 50 and the inside of container 40.

The operation of the refrigerator unit will not be described in the following.

The fluid arrives at said compressor 14 in a gaseous state. The compressor 14 compresses the fluid (there is now an unavoidable contamination of the fluid with oil) and delivers the fluid to said defroster 16 and then to condenser 20 (in the direction of the arrows shown in the figure). Here an ambient air stream drawn in the direction of arrow A by said fan 24 and ejected in the direction of arrow B cools down and liquefies the fluid. The fluid is then directed to said tank 22 and therefrom to inlet 46 of said heat exchanger 58 of device 30. In said heat exchanger 58 the fluid (still in liquid state and under pressure) is subcooled, then it exits from outlet 48, passing through filter 36 and entering said expansion block 50. Here the fluid is expanded, exits from outlet 54 and is supplied to distributor 32 and therefrom to evaporator 34. Herein, the fluid is mostly evaporated, taking up the heat of a hot air stream drawn in the direction of arrow C and ejected as cold air by fan 38 in the direction of arrow D.

The cooling fluid, which is mostly in a gaseous state, but containing liquid parts and oil, is introduced into said chamber 62. The liquid is separated by collecting in said tank or basin 60, and the gas portion exits from outlet 43 and is supplied to said compressor 14. As the liquid level increases, the float will rise and the port uncovered by said head 74 is reduced, so that the evaporation entirely or almost entirely occurs only through said injector nozzle 51. Accordingly, the pressure in said evaporator 34 and chamber 62 will decrease and the refrigerating or cooling fluid in liquid state in said device 30 will be evaporated. Therefore, said device 30 provides an automatic adjustment of the expansion, adjustment which is effected depending on the liquid level at the outlet from the evaporator.

It will be appreciated that the adjustment for the inlet device of varying section could be provided by any means for detecting the amount of liquid outflowing from the evaporator. In the exemplary embodiment shown, reference was made to a container containing a float, but also a probe 61 sensitive to the liquid level could be provided, or any electric or electronic element capable of sensing the amount of liquid contained in the fluid flow coming from the evaporator or evaporators.

It will be appreciated that this novel unit has the advantage of being suitable to operate within wide temperature ranges without requiring any adjustment: to increase the refrigeration units, what is accordingly required is only to evaporate a larger amount of liquid from the compressor. Additionally, this unit provides a perfect automatic separation of the gaseous cooling fluid from the liquid lubricating oil prior to supply to the compressor, since the liquid automatically settles on the bottom of container 40, while the gas is drawn from the top outlet 43. It will also be appreciated that the expansion block can be readily disassembled for cleaning.

What we claimed is:

1. In a compression type refrigerator, comprising a compressor, a condenser for cooling and condensing said fluid from said compressor, an expander for expanding the cooled fluid, and an evaporator for evaporating the expanded fluid; the improvement in which said expander comprises two expansion nozzles in parallel with each other, one said nozzle being fixed and the other said nozzle having an adjustable cross-sectional area, and means responsive to the amount of liquid leaving said evaporator to vary said cross-sectional area inversely as said amount.

2. Apparatus as claimed in claim 1, and a container for receiving liquid leaving said evaporator, said responsive means including means responsive to the level of liquid in said container to reduce said cross-sectional area as said liquid level rises, and vice versa.

3. Apparatus as claimed in claim 2, and at least one outlet for the recovery of lubricating oil from the bottom of said container.

4. Apparatus as claimed in claim 1, and a container for receiving liquid leaving said evaporator, and an expansion block mounted on said container, said nozzles being disposed in said expansion block.

5. Apparatus as claimed in claim 4, said expansion block comprising a plate integral with said container and having a through aperture for said responsive means.

6. Apparatus as claimed in claim 1, and a container for receiving liquid leaving said evaporator, and a heat exchanger disposed in said container and immersed in said liquid, said fluid flowing through said heat exchanger to said nozzles.

* * * * *